United States Patent [19]

Kaufman et al.

[11] Patent Number: 4,842,028

[45] Date of Patent: Jun. 27, 1989

[54] FLUID TRANSFER APPARATUS

[75] Inventors: Stephen B. Kaufman; Dale L. Robson, both of Highland Park, Ill.

[73] Assignee: Baxter International Inc., Deerfield, Ill.

[21] Appl. No.: 49,233

[22] Filed: May 13, 1987

[51] Int. Cl.[4] ..... B65B 3/16

[52] U.S. Cl. ..... 141/114; 141/10; 141/330

[58] Field of Search ..... 141/57, 114, 329, 330, 141/129, 163, 164, 180, 1, 2, 9; 312/72; 604/408, 414, 416

[56] References Cited

U.S. PATENT DOCUMENTS

| | | | |
|---|---|---|---|
| 684,002 | 10/1901 | Sorg | 312/72 |
| 3,245,200 | 4/1966 | Shaw . | |
| 3,575,099 | 4/1971 | Levenson | 141/83 X |
| 3,589,412 | 6/1971 | Levenson | 141/95 |
| 3,661,189 | 5/1972 | Bowser et al. | 141/329 X |
| 3,722,557 | 3/1973 | Huggins | 141/329 X |
| 3,788,369 | 1/1974 | Killinger | 141/114 |
| 3,835,897 | 9/1974 | Gess | 141/98 |
| 3,882,909 | 5/1975 | Ogle | 141/329 X |
| 3,915,652 | 10/1975 | Natelson | 141/130 X |
| 4,234,540 | 11/1980 | Ginsberg et al. | 422/64 |
| 4,275,775 | 6/1981 | Egli | 141/83 |
| 4,313,735 | 2/1982 | Yamashita et al. | 364/498 X |
| 4,333,356 | 6/1982 | Bartels et al. | 73/864.21 |
| 4,433,974 | 2/1984 | Bischof | 604/407 |
| 4,451,433 | 5/1984 | Yamahita et al. | 422/63 |
| 4,458,733 | 7/1984 | Lyons | 141/114 X |
| 4,473,884 | 9/1984 | Behl | 364/479 |
| 4,530,202 | 7/1985 | Powell et al. | 141/57 X |

*Primary Examiner*—Harvey C. Hornsby
*Assistant Examiner*—Scott J. Haugland
*Attorney, Agent, or Firm*—Paul C. Flattery; Gary McFarron; Mary R. Jankousky

[57] ABSTRACT

Apparatus for the automated transfer of contents between a rubber diaphragm port-type vial and a flexible, collapsible bag for medical solutions, which bag has at least one needle-pierceable access port. A double-pointed hollow needle is positioned so that the vial is held with its rubber diaphragm facing one pointed end of the needle and the medical solution bag is held with its needle-pierceable access port facing the other pointed end of the needle. Apparatus is provided for bringing the vial and bag into needle-penetrated relation, to provide flow communication therebetween through the hollow needle. Means are also provided for compressing the bag to force liquid from the bag into the vial; and for releasing the compression to allow the liquid to flow from the vial back to the bag. As a result of this, the original contents of the vial may be carried into the bag in automated manner.

11 Claims, 3 Drawing Sheets

12
44
46
46a
48
50
52
54
56
58
60
62
64
66
68
70
72
74
75
76
78
80
82
26

FLUID TRANSFER APPARATUS

TECHNICAL FIELD

Many drugs are often administered by addition to an intravenous set which communicates through an IV needle with a vein of the patient. This permits repeated doses of the drug to be administered to the patient without subjecting him to a hypodermic needle stick. Additionally, the drug is directly administered to the venous system of the patient, which provides more rapid distribution of the drug throughout the patient's body.

Many drugs, for example cancer chemotherapeutic agents and antibiotics, are sold in dry form, being stored in conventional vials having a rubber needle-pierceable diaphragm port. Certain inconveniences and difficulties exist in preparing such dry drugs for intravenous administration.

Typically, the dry drug is reconstituted into solution making use of a small intravenous solution bag, for example a MINI-BAG T.M. unit sold by Travenol Laboratories, Inc. of Deerfield, Ill. To accomplish this, the nurse obtains sterile intravenous solution either from a larger bag or the MINI-BAG unit by means of a needle and syringe under sterile conditions. This aliquot of sterile solution is then inserted into the vial of dry drug by penetrating the rubber diaphragm port with the needle and depressing the syringe plunger to place the liquid into the vial. The nurse then shakes the vial to cause the dry drug to dissolve in the solution, following which the drug is withdrawn again into the syringe, and returned in sterile manner through an injection port of the MINI-BAG unit. This MINI-BAG unit can then be connected to an IV set in conventional manner, with its solution contents passing into the set and then into the venous system of the patient, carrying the dissolved drug with it.

Difficulties have been found to exist with respect to this manual practice. First, it is time consuming, requiring the attentions generally of a skilled nurse.

Secondly, it has been found that minute quantities of the drug contents of the vial are released from the vial during the process. This may take place when the solution is injected into the vial, since that naturally elevates the internal pressure within the vial, causing some bleeding of solution and drug through the diaphragm at the needle penetration site thereof. Additionally, more drug carried in solution can spatter into the atmosphere as the needle is withdrawn from the diaphragm. It is very undesirable for nurses to be regularly in contact with certain drugs. Cytotoxic drugs can actually have an effect on the nurse resulting in hair loss. Repeated contact with minute doses of antibiotics may cause the nurse to go into anaphylactic shock, or set off some other allergic reaction.

Additionally, the sterility of the manual techniques for reconstituting dry drugs out of a vial is clearly in question. A cough or a sneeze, a stray touch of the finger on the part of the nurse, could contaminate the system.

Additionally, the possibility always exists that, through a case of mistaken identity, the nurse has reconstituted the wrong drug, or a wrong dosage of the right drug. There is no guarantee that the proper labelling will be placed on the MINI-BAG unit. Thus, with the manual technique, accident or mistaken identity may happen. Other techniques for reconstituting dry drugs for intravenous administration are known as well, but they all tend to be expensive or cumbersome, requiring refrigeration in some cases, and special equipment in others.

In accordance with this invention, an apparatus is provided for automatically and aseptically transferring a powdered drug from a sealed container to a parenteral solution container with any amount of mixing deemed desirable. The device can be preprogrammed and computer controlled, and can eliminate the disadvantages outlined above in that the operator is moved away to an extent from the drug-containing vial during processing, to be protected from exposure to drugs which are released from the vial, and the overall amount of drug released from the vial can be reduced. Additionally, the sterile technique can be improved, and the possibility of mislabeling is substantially eliminated, coupled with significant saving of processing time and a reduction in cost. Additionally, the drugs may be reconstituted into intravenous form directly from standard design vials of dry drug as received from their manufacturers, so that the entire spectrum of available drugs may be immediately used for reconstitution into IV solution in an automated manner. Additionally, the apparatus may be set up to provide selectivity among a selection of different drugs and dosage forms in their respective vials so that one may simply order the machine to prepare a large number of different reconstituted drug-containing IV solution aliquots in flexible containers, ready for connection to IV sets, with the nature and dosage of the drug form in each case being labelled on the IV collapsible container.

DESCRIPTION OF THE INVENTION

In this invention, apparatus is provided for the automated transfer of contents between a rubber diaphragm port-type vial and a flexible, collapsible bag for medical solution, such bag have at least one needle-pierceable access port.

Means are provided for positioning a double pointed hollow needle in a predetermined position. Means are also provided for holding the vial described above with its rubber diaphragm facing one pointed end of the needle, while other means are provided for holding the medical solution bag with its needle-pierceable access port facing the other pointed end of the needle. The apparatus then serves to bring the vial and bag into needle-penetrated relation, with one end of the double pointed needle penetrating each unit, to provide flow communication therebetween through the hollow needle.

Means are then provided for compressing the bag to force liquid from the bag into the vial, and also for releasing such compression to allow the liquid to flow from the vial back to the bag. As a result of this, the original contents of the vial may be carried into the bag in automated manner, typically by a repeated series of 2 to 10, for example, cycles of compression and release to cause liquid flow from the bag into the vial, followed by liquid flow from the vial back into the bag, this process being repeated until the drug is fully dispersed into the liquid so as to permit intravenous administration thereof.

The double-pointed, hollow needle may have means permitting venting of gas but not liquid from the vial. This may constitute a little side port which carries a hydrophobic air vent, generally a porous piece of hydrophobic plastic which permits air to pass through it but not aqueous liquid. Alternatively, a single-pointed hollow needle may be positioned with the double-printed needle to penetrate the vial but not the bag. The single-pointed needle in this case may carry a porous, hydrophobic plastic member to permit gas venting but not liquid venting. Additionally, if desired, the outer end of the single-pointed needle may be connected with a balloon which can be inflated with air from the connected system as the bag is compressed, so that the collapsing balloon forces the air back into the system and the liquid back into the bag when compression of the bag is released. As a further alternative, the outer end of the single-pointed needle may be connected with a source of suction and pneumatic pressure, for further control of the flow between the vial and bag.

The apparatus of this invention may have means provided for storing a plurality of the double-pointed, hollow needles, plus means for delivering them one by one to said positioning means in automated manner. Thus separate needles may be used for each procedure without the need for manual set-up.

Similarly, means may be provided for storing a plurality of the vials plus means for selecting a desired vial and placing the vial in the vial holding means in automated manner, for further elimination of the need for manual intervention in the operation of the apparatus.

It may also be desirable to include means for marking the medical solution bags with indicia which correlate with indicia on the vial which is connected to the bag, in automated manner, to provide identification on the bag of the contents from the vial placed in the bag. This may be accomplished with a conventional bar code reading system, for example, for reading a bar code on the vial, plus microprocessor means for controlling a printing system which prints appropriate indicia on the bag corresponding to the bar code as read. This automated identification system can eliminate human error which may result when manual labelling of the bags is required.

Specifically, the vial storing means may include an annular vial-carrying magazine, plus means for rotating the magazine to permit positioning of any vial in the magazine to permit placing of the vial in the vial holding means. This function may be controlled by the microprocessor means, with the result that the user can simply order one specific drug or dosage of drug in a specific vial, one vial out of many, and by this apparatus it can be automatically reconstituted into a medical solution bag under better aseptic conditions than can be accomplished manually, and with greater protection to the operator. Additionally, the bag may be labelled with the added drug in reliable, automated manner for elimination of human error.

Additionally, automated means for loading the medical solution bags may be provided. As a further modification, the sterile medical solution for reconstituting the drug in the vials may come from a central source of supply, for example a one liter bag of solution carried by the machine, with the aliquot of reconstituted solution being then transferred from the vial to a small medical solution bag, which may be initially empty.

The vial, needle, and bag may be carried in their respective positioning and holding means in a chamber. This chamber may have ultraviolet light applicator means so that, during the process, and particularly when the vial, needle, and bag are separate, sterilization of the components may take place to further reduce the risk of contamination.

The means for compressing the bag during operation of the apparatus may comprise a moveable platen, plus means for pressing the platen against, and withdrawing the platen from, the bag when carried in its holding means. This pressing means may be a simple pneumatic or hydraulic piston operating against the platen. Alternatively, a roller member may be used to compress the bag, or any other means as desired.

As one alternative, means may be provided for bringing the vial and bag into the needle-penetrated relation, by relatively moving the vial and bag together in a generally horizontal direction, the needle extending generally horizontally as well. This can provide advantages of operation. It is to be understood that this concept includes the idea of moving only one of the vial and bag while the other remains stationery, and moving the needle itself, if desired, to bring the components together in needle-penetrating relation.

Following connection of the vial and bag together in needle-penetrating relation, the needle-penetrating vial and bag may be rotated into generally vertical relation with the vial on top. Typically, the needle which penetrates the vial extends to a distance sufficient to communicate with an air space within the vial.

Venting means may also be provided, so that as liquid is inserted into the vial, gas within the vial may be vented to avoid pressure buildup within the vial. This, in turn, reduces the possibility of liquid containing dissolved drug from oozing or spattering through the sealing diaphragm, providing greater protection to the nurse or other operator from undesired contact with drugs.

DESCRIPTION OF SPECIFIC EMBODIMENTS

Figure 1:
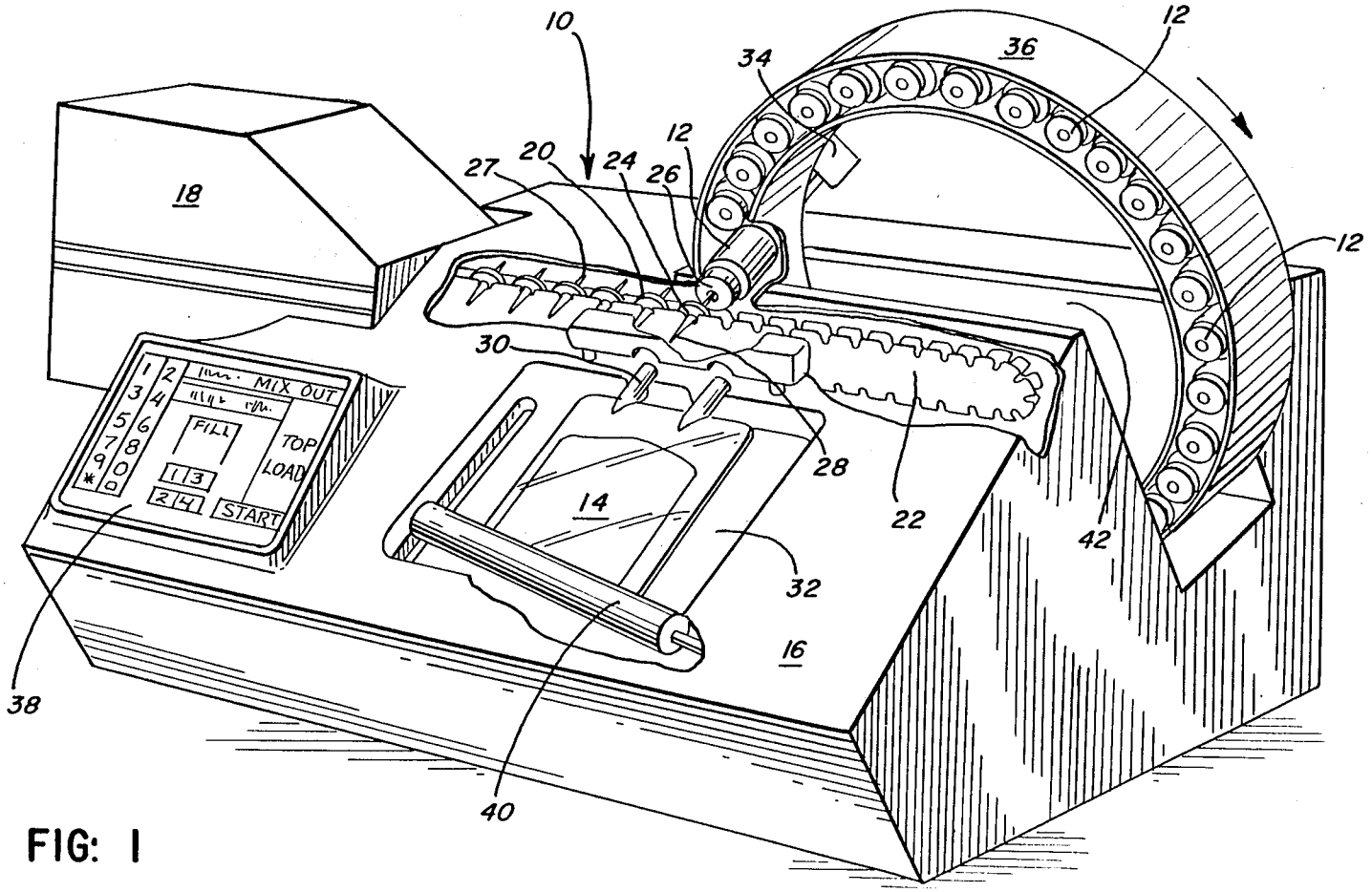
FIG. 1 is a perspective view of one embodiment of the apparatus of this invention.

Referring to FIG. 1, apparatus 10 is shown for the automated transfer of contents between a rubber diaphragm port-type vial 12 and a flexible, collapsible bag 14 for medical solutions. Both vial 12 and bag 14 may be of conventional design, of a type which is currently in commercial use. Apparatus 10 includes housing 16, which, in turn, includes storage apparatus 18 for providing a series of double pointed, hollow needles 20 to a conveyor belt apparatus 22, to transfer needles 20 from storage apparatus 18 to position 24 where a double pointed needle 20 is shown to be in a position where one of its projecting needles is capable of entering into engagement with the rubber diaphragm 26 of vial 12, and a pointed hollow needle portion 28 is positioned to enter access port 30 of bag 14.

Platen 32 may then shift bag 14 forwardly to drive the respective pointed end of needle 24 into access port 30 while at the same time advancing the hollow double pointed needle at position 24 into flow communicating engagement with vial 12 by pushing its pointed needle end through diaphragm 26. Alternatively, or in substitution therefore, push rod assembly 34 may advance vial 12 into needle penetrated relation with the double pointed hollow needle assembly at position 24.

As shown, an annular magazine 36 is provided for carrying a large plurality of vials 12. Magazine 36 may be rotated to a desired position so that a desired vial 12 is positioned to be placed into engagement with double pointed needle 20 at position 24.

It is contemplated that vials 12 in magazine 36 may contain different contents or dosages of various drugs, with the specific drug and dosage being identified by a bar code on the outside of vial 12 or the like. A bar code reader machine may be included in apparatus 10 so that the individual bar codes of the specific vials 12 may be read. Accordingly, one may punch in a desired code for a specific drug or dosage at control panel 38, causing, through appropriate logic circuit within apparatus 10 and a conventional bar code reading machine, for carousel 36 to index in circumferential motion as the bar code reader reads the various bar codes on the vials 12. When a vial having the appropriate bar code called for is located, it is positioned by rotating carousel 36 into the position as shown, for engagement with double pointed needle assembly at position 24, in automated manner.

Thereafter, as stated above, plunger 34 and/or platen 32 may be operated to bring the particular vial 12 and bag 14 into engaged relation with the particular double pointed needle 20 at position 24.

Following this, bag compression means 40, specifically shown to be a movable roller, is actuated, which causes liquid in bag 14 to be forced through the hollow double pointed needle assembly 20 into the interior of vial 12, where the liquid picks up dry drug or the like and dissolves it. Roller 40 may then be released, causing the drug-laden liquid to pass out of vial 12 through needle assembly 20 back into bag 14. This process is generally repeated several times, until the drug contents of vial 12 are completely dissolved through the turbulence generated by passing the solution from bag 14 into vial 12 and allowing it to drain again back into bag 14.

This process can take place automatically, being governed by control panel 38, by means of a conventional microprocessor and other electronic equipment.

At the end of this process, the connected bag 14 and vial 12 may be removed from their respective positions as shown in FIG. 1. Access port 30 may be sealed in conventional manner with a bar sealer, and vial 12 and needle assembly 20 may be removed and discarded. If the particular drug in the vial is selected manually rather than by means of a bar coding device, the attached vial 12 serves as a good identification for what drug has been reconstituted into the solution within bag 14. One may then transfer this information to the label of bag 14, having the actual vial connected to the bag while doing so. Alternatively, an automated printer may be connected to apparatus 10 for direct printing of the identification of drug placed into bag 14 in a manner which is an extension of the automated process made possible by this invention. Specifically, the microprocessor means within apparatus 10 may direct a printer apparatus for putting the desired identification on the label of bag 14. One simply removes bag 14 and places it into the printer for such printing process, to eliminate the possibility of error in transcription of information from vial 12 to bag 14.

After bag 14 has been removed, another bag 14 is installed on platen 32, for a repetition of the process. Conveyor belt 22 indexes one space to put the next adjacent, double pointed needle 20 into position 28. As instructed by control panel 38, carousel-type magazine is indexed to search for a vial having the appropriate bar code as ordered by the instructions entered through control panel 38. When found, the particular vial 12 is rotated into position of engagement with the needle assembly at positon 24, and the process may be repeated.

Alternatively, carousel 12 may simply index in a sequential manner, with vials 12 being all of the same drug. If a different type of drug is desired for reconstitution, another carousel 12, containing such drug may be inserted in carousel housing 42, from which each carousel 36 may be easily inserted or withdrawn, as a conventional mechanical expedient.

Additionally, if desired other automated apparatus may be provided for removal of the outer cap of vial 12 after it has been selected and/or added sterilization of the outside of diaphragm 26 of the selected vial 12, to provide a better aseptic, needle-penetrating connection between vial 12 and the appropriate hollow needle of member 20 at location 24.

Figures 2, 3:
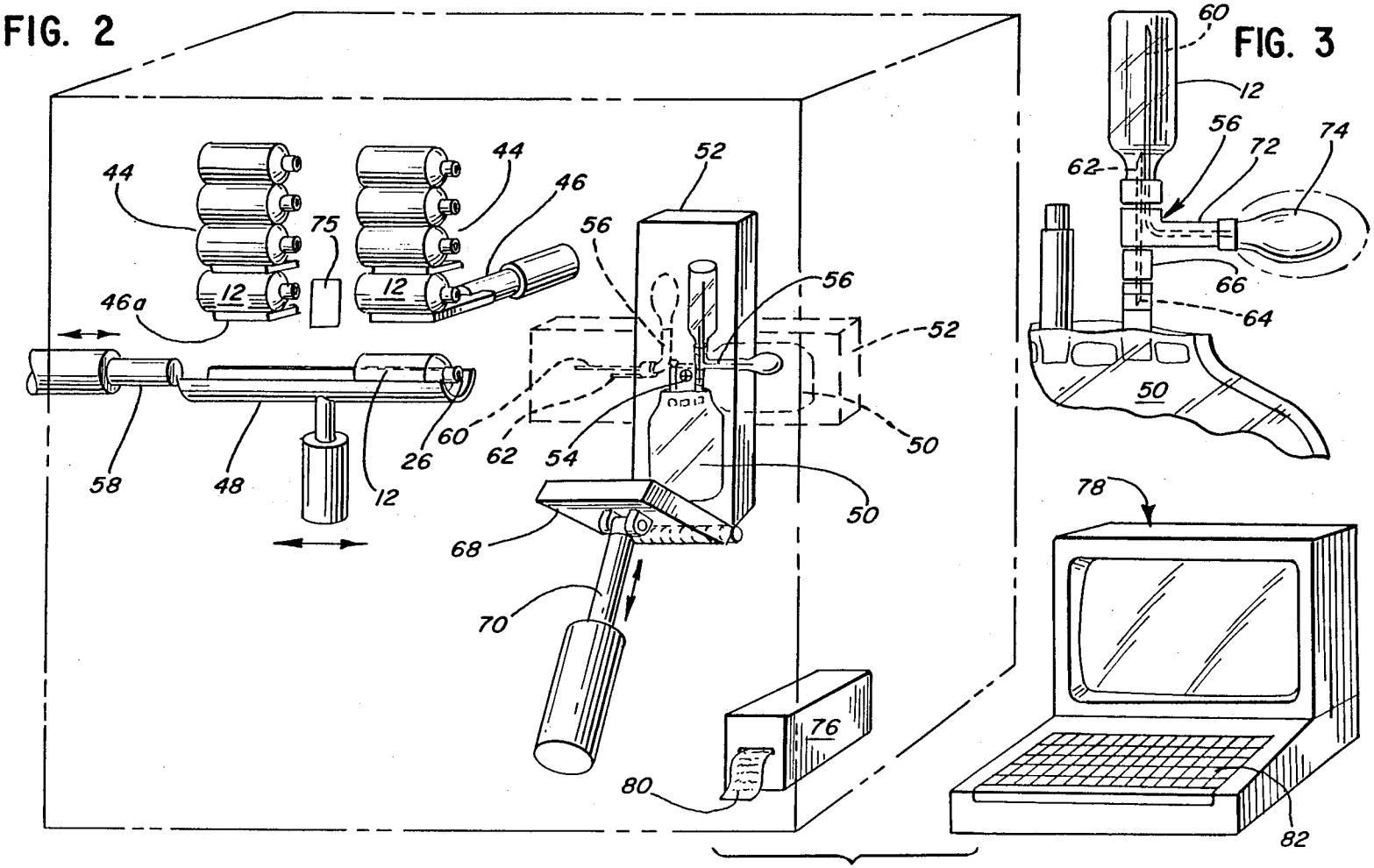
FIG. 2 is a perspective view of critical portions of another embodiment of the apparatus of this invention, with certain portions not necessary for an understanding of the invention being deleted.
FIG. 3 is a fragmentary elevational view of a flexible collapsible bag connected with a rubber diaphragm port-type valve in accordance with this invention.

Turning to FIGS. 2 and 3, an alternate design for the apparatus of this invention is shown in rather schematic manner, with parts unnecessary for an understanding of the invention being deleted. Generally, the missing parts are simple mechanical expedients for accomplishing the various necessary functions disclosed herein.

Vials 12, in this case, may be supported in a pair of chutes 44. Control members 46, 46a serve to retain each vial 12 until needed for use. Upon retraction of one of control members 46, 46*a*, a vial 12 can fall horizontally into trough 48, as shown.

Bag 50 is shown to be positioned in a rotatable holder member 52, which rotates about pivot 54, to be rotatable between vertically and horizontally directed positions. The horizontal position of holder member 52 is shown in phantom lines, and is positioned to align bag 50 in horizontal relation with the vial 12 which occupies trough 48.

Double-pointed needle apparatus 56 is shown in greater detail in FIG. 3, and is shown twice in two configurations in FIG. 2. The version of double pointed needle apparatus 56 shown in dotted lines illustrates its horizontal position as it is retained in holder 52 in the horizontal position, while the same member 56 shown in full lines shows its position within holder 52 in the vertical position.

In the horizontal position, trough 48 and plunger member 58 may be advanced so that both hollow needles 60, 62 penetrate the rubber diaphragm 26 of vial 12. Plunger 58 can advance along trough 48 to drive vial 12 into such needle penetrated relation. At the same time, bag 50, which is retained in holder 52, may be retained and aligned so that, in the same operation, pointed end 64 of needle 62 penetrates access port 66 (FIG. 3) of bag 50.

Accordingly, by this process and as shown in FIG. 3, vial 12 and bag 50 may be connected together through double pointed spike assembly 56.

After such connection has been made, holder 52 may be pivoted to the vertical position as shown. Hinged platen 68 may then be closed by the action of piston 70 to press against bag 50 to cause liquid contents of bag 50 to be forced upwardly through needle 62 into vial 12. At the same time, air which is in vial 12 may pass through hollow needle 60 out through side arm 72 where it may be collected by balloon 74 which, naturally, inflates in the process. Alternatively, balloon 74 may be replaced with a known type of porous, hydrophobic filter member which permits the passage of gas but not aqueous liquid, and which is generally bacteria blocking.

Platen 68 may then be released, causing solution that has entered vial 12 to flow once again back into bag 50, by gravity, and also possibly by the natural tendency of inflated balloon 74 to deflate, and to provide a back pressure through vial 12 as it does so.

This process of pressurizing bag 50, to cause fluid to flow into vial 12, may be repeated as often as necessary to cause the contents of vial 12 to be dissolved or adequately suspended in the solution of bag 50. At the end of the process, the solution and the reconstituted contents of vial 12 occupy bag 50.

Following this, bag 50 with its connected double pointed spike member 56 and vial 12 may be removed from holder 52. Bar code scanner 75 will have recorded the specific identifying bar code found on the vial being processed. As controlled by the computer system 78 controlling the apparatus, printer 76 may then print a label 80, which may be attached to bag 50. Alternatively, printer 76 may directly print the information on bag 50 without the use of an intermediate label. Computer 78 with its logic circuitry can also select between the various columns of vials 12 as shown in FIG. 2, with each column of vials optionally constituting a different type of drug or concentration thereof, so that, as in the previous embodiment, automated selectivity may be provided, with the desired vial being selected, connected, and its contents reconstituted in automated manner through instructions given through keyboard 82 of computer system 78.

As before, access port 66 of bag 50 may be sealed shut with a conventional bar sealer, and vial 12 in spike assembly 56 may then be removed.

The degree to which platen 68 is advanced against bag 50 may also be controlled by specific instructions from computer 78 for added controllability of use of the device of this invention.

Double pointed spike assembly 56 may be manually inserted into holder 52 after every procedure, if desired, or automated means for manual insertion of a series of members 56 may be utilized, if desired.

Figure 4:
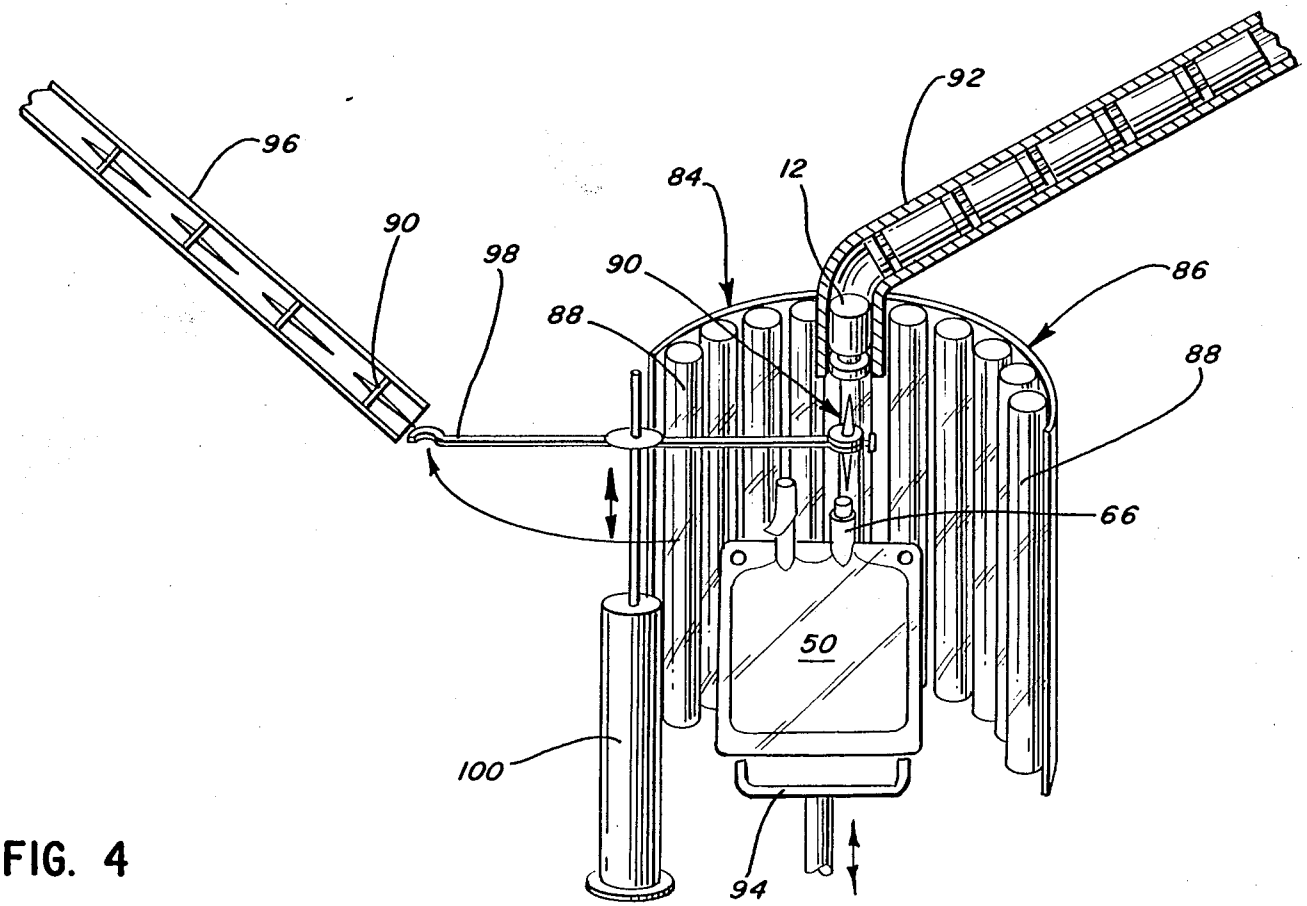
FIG. 4 is a fragmentary, perspective view of an alternative mechanism for use in apparatus of this invention.

Referrring now to FIG. 4, an alternative design of the portion of the apparatus of this invention which provides for connection of bags and vials with the respective double pointed spikes is disclosed. It is contemplated that this apparatus 84 may be used as a substitute for the corresponding apparatus in the design of FIG. 2, or the device of FIG. 1 may be also appropriately modified to make use of the device of FIG. 4.

In this embodiment, the connection between bag 50 and vial 12 is made within a chamber 86, only half of which is shown, but which generally is conventionally provided to be a closed chamber without light leakage. Ultraviolet light bulbs 88 are provided, to irradiate from all desired angles the surfaces of double pointed hollow spike assembly 90, particularly prior to the making of actual connection with vials 12 and access ports 66 of each bag 50. By this expedient, ultraviolet irradiation can provide antimicrobial action to the exposed surfaces of double pointed hollow spike 90, as well as the exposed surfaces of rubber diaphragm vial 12 and access port 66.

Vials 12 are shown to be fed to the desired position by means of chute 92, being conventionally retained in position until it is desired for them to be released after the connection has been made. Bag 50 may be firmly carried by and advanced with frame 94, which is capable of moving upwardly as shown, to force the connection of double pointed spike 90 with both bag 50 and vial 12, during or after the ultraviolet irradiation step.

Frame 94 is then withdrawn downwardly again, bringing double pointed spike 90 and the connected vial 12 with them, while the next vial advances into position, and bag 50 and its attached pieces may be withdrawn for further processing or use.

Another double pointed spike 90 is carried by chute 96, to be picked up by carrier member 98 which is rotatably positioned on rotater member 100. When it is desired to put another double pointed spike 90 into position, rotater member 100 rotates carrier 98 by 180 degrees to accomplish this purpose, and to provide an empty receiver in the carrier arm for receipt of another double pointed spike member 90.

Thus the apparatus of this invention provides flexible and versatile ways for automated reconstitution of dry drugs and the like in a vial, making use of solution in a bag into which the dry drugs are to be placed, or, if desired, the solution may come from a larger source container and be placed into the vial and then the smaller storage bag, for carrying the reconstituted drug solution. By this apparatus, automated or semi-automated reconstitution of drugs can take place, with a considerable savings in time of the technician, and with great reliability and reduction of contamination of the sterile conditions.

The above has been offered for illustrative purposes only, and is not intended to limit the scope of the invention of this application, which is as defined in the claims below.

We claim:

1. An apparatus for the automated transfer of contents between a rubber diaphragm port-type vial and a flexible, collapsible bag for medical solutions, said bag having a first needle-pierceable access port, and utilizing a double-pointed hollow needle having a first and second ends:

a row of said vials, a row of said double-pointed hollow needles, linear advancement means for holding and sequentially positioning said row of said double-pointed hollow needles, one by one into a first position for vial and bag engagement;

multiple advancement means for holding and sequentially positioning said row of said vials, one by one, into a position for engagement with said first end of said double-pointed hollow needle in said first position through said rubber diaphragm;

means for holding said medical solution bag with said first needle-pierceable access port facing said second end of the needle in said first position;

means for bringing the vial in said engagement position and the bag into needle-penetrated relation, to provide flow communication therebetween through said hollow needle; and mechanical means for holding and compressing said bag to force liquid from said bag into the vial, and for releasing said compression to allow said liquid to flow from the vial back to the bag, whereby the original contents of the vial may be carried into the bag in an automated manner.

2. The apparatus of claim 1 in which said double-pointed hollow needles have means permitting venting of gas but not liquid from said vial.

3. The apparatus of claim 1 which includes means for selecting one of said vials in said row in said multiple advancement means and placing said selected vial into said position for engagement with said double-pointed hollow needle in said first position in an automated manner.

4. The apparatus of claim 3 which includes means for marking said medical solution bag with indicia which correlate with indicia on said select vial which is connected to said bag, in an automated manner, to provide identification on the bag of the contents from said vial placed in the bag.

5. The apparatus of claim 3 which in said multiple advancement means includes means for storing a said row of said vials, in which said vial storing means includes an annular, vial-carrying magazine plus means for rotating said magazine to permit positioning of said selected vial in the magazine into said position for engaging said first end of said double-pointed hollow needle in said first position in the vial holding means.

6. The apparatus of claim 1 including means defining a chamber housing said apparatus, said chamber having ultraviolet light applicator means to irradiate said vial, needle, and bag.

7. The apparatus of claim 1 in which said bag compressing means comprises a moveable platen plus means for pressing said platen against, and withdrawing said platen from, said bag when carried in its holding means.

8. In apparatus for the automated transfer of contents between a rubber diaphragm port-type vial and a flexible, collapsible bag for medical solutions, said bag having a first needle-pierceable access port, and utilizing a double-pointed hollow needle having first and second ends:

a row of said vials, a row of said double-pointed hollow needles, linear advancement means for holding and sequentially positioning said row of double-pointed hollow needles, one by one into a first position for vial an bag engagement;

multiple advancement means for holding and sequentially positioning said row of said vials, one by one, into a position for engagement with said first end of said double-pointed, hollow needle in said first position through said rubber diaphragm, said multiple advancement means including an annular, vial-carrying magazine plus means for rotating said magazine to permit positioning of any vial in the magazine in said engagement position for engaging the double-pointed, hollow needle in said first position; means for holding the medical solution bag with said first needle-pierceable access port facing the second pointed end of said double-pointed, hollow needle in said first position;

means for bringing the vial in said engagement position and the bag into needle-penetrating relation, to provide flow communication therebetween through said hollow needle; and mechanical means for compressing said bag to force liquid from said bag into said vial in said engagement position, and for releasing said compression to allow said liquid to flow from the vial back to the bag, whereby the original contents of said vial in said engagement position may be carried into the bag in an automated manner.

9. The apparatus of claim 8 which includes printing means for marking said medical solution bags with indicia which correlate with indicia on said vial in said engagement position which is connected to said bag, in an automated manner, to provide identification on the bag of the contents from said vial placed in the bag.

10. The apparatus of claim 8 including means defining a chamber housing said apparatus, said chamber having ultraviolet light applicator means to irradiate said vial, needle, and bag.

11. The apparatus of claim 8 in which said bag compressing means comprises a movable platen plus means for pressing said platen against, and withdrawing said platen from, said bag when carried in its holding means.

* * * * *